US006860794B1

(12) United States Patent
Palushi et al.

(10) Patent No.: US 6,860,794 B1
(45) Date of Patent: Mar. 1, 2005

(54) METHOD OF POLISHING CONCRETE SURFACES

(75) Inventors: Simon Palushi, Shelby Township, MI (US); Horst J. Finkenauer, White Lake, MI (US)

(73) Assignee: Epoxi-Tech Inc., Madison Heights, MI (US)

( * ) Notice: Subject to any disclaimer, the term of this patent is extended or adjusted under 35 U.S.C. 154(b) by 0 days.

(21) Appl. No.: 10/345,682

(22) Filed: Jan. 16, 2003

(51) Int. Cl.[7] ..... B24B 1/00

(52) U.S. Cl. ..... 451/41; 451/28; 451/36; 451/58; 451/60

(58) Field of Search ..... 451/28, 36, 37, 451/41, 58, 60; 404/78; 106/3; 52/741.15

(56) References Cited

U.S. PATENT DOCUMENTS

| | | | | |
|---|---|---|---|---|
| 165,898 A | | 7/1875 | Watson | |
| 1,965,299 A | | 7/1934 | Patterson | |
| 2,196,992 A | | 4/1940 | Keller | |
| 3,098,329 A | | 7/1963 | Doran | |
| 3,540,891 A | | 11/1970 | Muhler | |
| 3,615,305 A | | 10/1971 | Muhler | |
| 3,685,218 A | | 8/1972 | Gambale et al. | |
| 3,721,048 A | | 3/1973 | Rand | |
| 4,155,596 A | | 5/1979 | Brejcha | |
| 4,565,644 A | | 1/1986 | Smith et al. | |
| 4,699,807 A | * | 10/1987 | Howell | 510/242 |
| 4,900,778 A | * | 2/1990 | Nagashima | 524/837 |
| 4,910,824 A | * | 3/1990 | Nagayama et al. | 15/98 |
| 5,026,421 A | | 6/1991 | Le Loarer et al. | |
| 5,057,152 A | | 10/1991 | Marcus et al. | |
| 5,066,350 A | * | 11/1991 | Sullins | 156/187 |
| 5,174,813 A | * | 12/1992 | Cifuentes et al. | 106/3 |
| 5,191,002 A | | 3/1993 | Davis | |
| 5,454,751 A | | 10/1995 | Wiand | |
| 5,605,493 A | * | 2/1997 | Donatelli et al. | 451/41 |
| 5,788,561 A | | 8/1998 | Pearlman et al. | |
| 6,155,907 A | * | 12/2000 | Jones | 451/28 |

FOREIGN PATENT DOCUMENTS

| | | | | |
|---|---|---|---|---|
| JP | 410237361 A | * | 2/1997 | C09D/5/28 |
| JP | 02003160759 A | * | 6/2003 | C09D/183/06 |

* cited by examiner

*Primary Examiner*—Lee D. Wilson
*Assistant Examiner*—Anthony Ojini
(74) *Attorney, Agent, or Firm*—Reising, Ethington, Barnes, Kisselle, P.C.

(57) ABSTRACT

A method of applying a protective gloss coating to a concrete floor includes applying a low viscosity organic coating to the concrete floor, removing the excess organic coating that lies above the peaks of concrete and curing the coating in place.

9 Claims, 1 Drawing Sheet

METHOD OF POLISHING CONCRETE SURFACES

TECHNICAL FIELD

The field of this invention relates to a polished concrete surface and more particularly to an improved method for polishing concrete surfaces like floors and walls.

BACKGROUND OF THE DISCLOSURE

Concrete is a very popular material for use in floors and construction materials because of its strength, durability and low costs. If the concrete is left unfinished, the concrete floor will inherently produce dust by the constant scuffing it undergoes whether by foot traffic or wheeled traffic. The resulting dust settles on all exposed surfaces and thus much effort in dusting shelves and inventory is needed to provide for a pleasing, fresh and attractive display in many retail and wholesale outlets.

A storeowner is thus faced with a dilemma of settling for a concrete floor with its no gloss utilitarian appearance and with the disadvantage of the inevitable dust that emanates from an unfinished concrete floor or spending considerable money for a protective and decorative covering surface. Previous decorative and protective covering surfaces provide only a partial solution because the covering surface is unable to withstand the constant abuse of heavy foot and vehicular traffic. The covering will eventually scratch and fail or wear down. After a time, the covering can become less attractive than the bare concrete that it originally covered. Further wear eventually re-exposes the concrete again which then re-introduces dust.

Another factor that is always of concern is that a floor needs to remain relatively dry and should not become overly slippery when wet. High gloss decorative stone floors such as granite or Terrazzo are well known to be relatively slippery and becomes even more slippery when wet. Any floor should have a frictional coefficient at least as great as polished granite when either wet or dry.

It also has been known to burnish wax into concrete flooring to produce an aesthetically desirable gloss or shine but this process is labor intensive and time consuming.

What is needed is an aesthetically pleasing polished concrete surface that is embedded with an organic coating to provide a relatively dust free surface that is durable, has a gloss, shine or polished look to it, is relatively skid-resistant and is stain resistant.

SUMMARY OF THE DISCLOSURE

In accordance with one aspect of the invention, a method of polishing a concrete surface includes the steps of applying a liquid coating to a concrete surface with the liquid coating having a low enough viscosity to soak into the upper layer of the concrete through its exposed pores and crevices. The application can be by roller, spray or power scrub or brush. The excess liquid coating above any peaks of concrete is then removed. Preferably the removal is by squeegee, vacuum or by scrubbing or wiping the excess away.

The liquid coating is then cured. The curing can be by ambient air and time or can be accelerated by well known UV curing procedures.

The concrete and cured coating is then polished preferably by grit of approximately 150 to remove any resin above the peaks and remove any bumps of cured coating. Highly desired shine is then produced by buffing or polishing with finer grit media, for example, up to 8500 grit.

In one embodiment it is preferred that the concrete is prepared before the application of the coating by being sanded with a grit large enough to open the porosity of the concrete surface before applying the liquid coating thereon. This can be accomplished preferably with a sanding tool with a grit of approximately 80.

The liquid coating preferably has surfactants mixed therein for promoting flow and spreadability onto said concrete surface and has a viscosity near water for allowing the free flow of the coating into the exposed pores of the concrete.

It is also preferred that the coating when cured is transparent. It can be clear in color, tinted, or opaque. It is preferred that the liquid coating is one of an organic epoxy resin, acrylic, urethane, alkyd or oil base.

BRIEF DESCRIPTION OF THE DRAWINGS

Reference now is made to the accompanying drawings in which.

DETAILED DESCRIPTION OF THE PREFERRED EMBODIMENT

Figure 1:
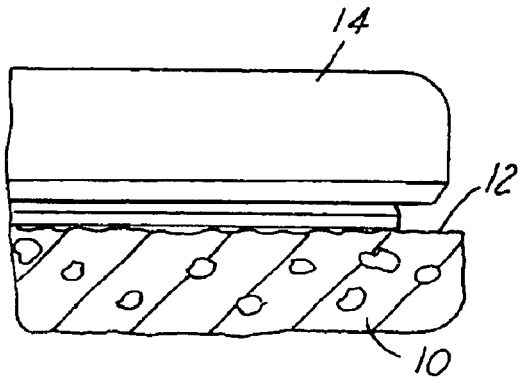
FIG. 1 is a side elevational and segmented view of a concrete floor being sanded with 80 grit sanding tool.

Referring now to FIG. 1, a concrete floor 10 with an unpolished surface 12 is sanded by a sanding tool 14 with approximately 80 grit or as low as 16 grit. The sanding tool may be a commercial industrial grade power sander with the appropriate 80 grit sand paper applied to the discs. If the concrete has stones or an aggregate therein, it is acceptable to grind the concrete until the aggregate or stones become exposed at the top surface. The concrete surface 12 is smoothed to the appropriate grit finish to assure that the concrete porous nature extends through to the surface.

The concrete floor 10 and surface 12 may be a new floor that is properly hardened and set or may even be an old used floor. The sanding away all upper level old coating and coverings to expose a relatively smooth unpolished concrete surface is required for preparation of an old used floor to receive a low viscosity coating.

Figure 2:
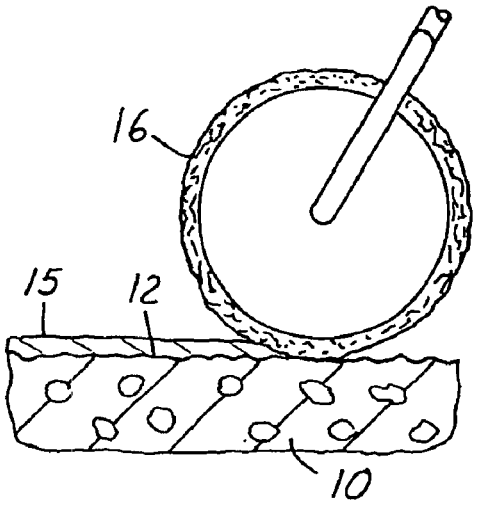
FIG. 2 is a view similar to FIG. 1 illustrating the application of a low viscosity coating by a roller.

A low viscosity coating 15, for example, an organic polymer, epoxy resin, acrylic, alkyd, oil base or urethane is then applied by roller 16 as shown in FIG. 2. Other applications such as spray, brush, power buff are equally acceptable. Commercially available epoxies such as Epon 828 cured with an amine or commercially available urethanes such as Desmophen/Desmodus or commercially available acrylics such as Alberting Lux 101 or an oil such as linseed can be used. Alkyds such as Min-Wax can be applied. The roller applies excess coating such that the coating fills all pores and valleys in the concrete surface 12 and extends into the pores near the surface to anchor the coating to the concrete. The roller 16 is a conventional commercially available paint roller that has knap for concrete surfaces. The coating has a low viscosity of approaching that of water and may have surfactants mixed therein. Such surfactants may be commercially available ones such as Byk 333 approximately 0.2% by weight. These surfactants can be mixed to improve the flow and spreadability of the coating over the concrete which also helps its flow into and its adhesion with the pores, exposed crevices and valleys in the concrete.

Figure 3:
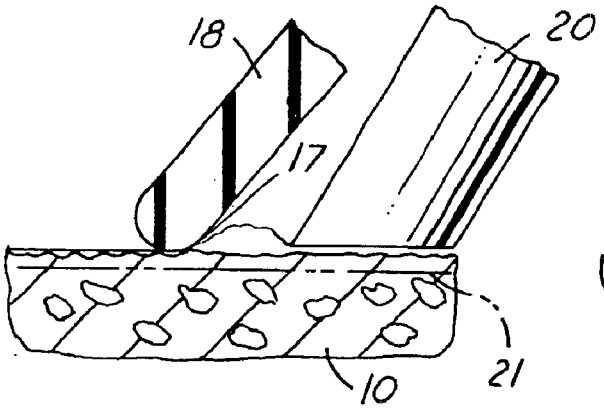
FIG. 3 is a view similar to FIG. 1 illustrating removal of excess coating above the concrete with both a vacuum and a squeegee.
Figure 4:
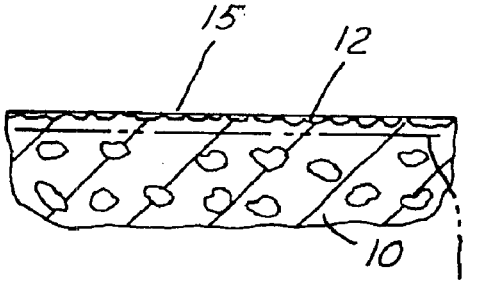
FIG. 4 is a view similar to FIG. 1 showing the concrete floor after curing but before the final polishing.
Figure 5:
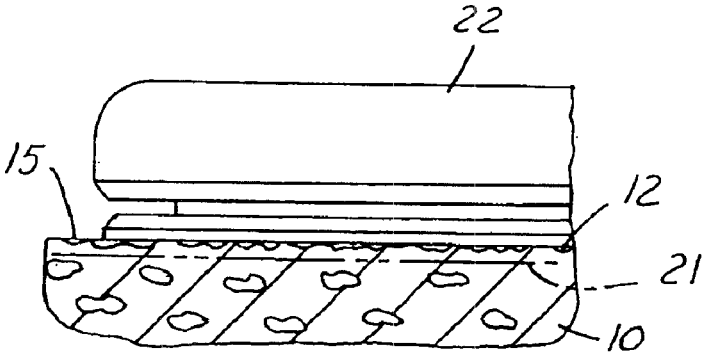
FIG. 5 is a view similar to FIG. 1 showing the floor being polished with sander of 150 grit to remove the excess cured coating above the concrete peaks.

After application as shown in FIG. 2, the excess coating 17 is immediately removed. By excess, it is meant all coating that lies above the peaks of the concrete surface. The excess may be removed by squeegee 18 and or by vacuum 20 as shown in FIG. 3. It also may be removed by scrubbing or wiping.

The residual coating lies only in the valleys and the exposed pores of the concrete surface and is embedded into the porous concrete a millimeter or so in depth as indicated by shadow line 21. The coating can be left to cure at room temperature with the ambient atmosphere, or it may be cured through UV application through known UV curing procedures.

After the coating is fully cured, i.e., fully hardened, it may be further polished with 150 grit sander 22. As with sander 14, the sanding may be by known commercial power sanders with the appropriate sanding or polishing element mounted thereon. The polishing with 150 grit should remove any inadvertent residual coating above the peaks of the concrete and also polish the coating surface that is even with the peaks of the concrete surface to provide a uniformly smooth surface with a gloss appearance but with a relatively high coefficient of friction compared to known granite floor surfaces. When more sheen is desired, buffing with fine grit up to 8500 can be applied. The coefficient of friction remains higher than granite flooring whether in the respective dry condition or wet condition.

As can be readily ascertained, the coating immersion into the concrete and filling the pores and valleys up to the peaks of the concrete surface significantly reduces concrete dust problems and will also reduce staining of the concrete from accidental spilling. Furthermore the aesthetically pleasing gloss shine introduced by the coating onto the floor is extremely durable finish that is resistant to scratching and failing due to its immersion into the valleys of the concrete and not being a film over the entire concrete surface. This also provides for an adequate coefficient of friction which some people commonly refer to as skid-resistant, and also provides a stain resistance. If the aggregate is exposed during the initial sanding preparation, the finished shine will provide a pleasing terrazzo stone like appearance due to combination of the gloss imparted to the surface and the stone appearance of the exposed and sanded aggregate.

Variations and modifications are possible without departing from the scope and spirit of the present invention as defined by the appended claims.

What is claimed is:

1. A method of polishing a concrete surface comprising the steps of:

applying an organic curable liquid coating to a concrete surface;

the liquid coating having a low viscosity to soak into the upper layer of the concrete through the concrete's exposed pores and crevices;

removing excess coating that lies above any peaks of concrete;

curing the liquid coating to seal the underlying concrete surface with its pores and crevices from ambient atmosphere;

polishing the concrete and cured coating to remove any coating above the peaks.

2. A method of polishing a concrete surface as defined in claim 1 further comprising the steps of:

sanding the concrete floor with a grit large enough to open the porosity of the concrete surface before applying the liquid coating thereon.

3. A method of polishing a concrete surface as defined in claim 1 further comprising the steps of:

sanding the concrete floor with a sander having ranges approximately 16–80 grit.

4. A method of polishing a concrete surface as defined in claim 1 further comprising the steps of:

said polishing the concrete and cured coating being with a grit of 150 or finer to remove any resin above the peaks of concrete.

5. A method of polishing a concrete surface as defined in claim 3 further comprising the steps of:

said liquid coating having surfactants mixed therein for promoting flow and spreadability onto said concrete surface;

said viscosity of said liquid coating being near that of water.

6. A method of polishing a concrete surface as defined in claim 1 further comprising the steps of:

said coating when cured being transparent.

7. A method of polishing a concrete surface as defined in claim 1, further comprising the steps of:

said coating when cured being opaque.

8. A method of polishing a concrete surface as defined in claim 1 further comprising the steps of:

of said organic curable liquid coating being applied by roller, spray or brush; and said removing any excess liquid coating being by squeegeeing and vacuuming excess coating above the peaks of concrete.

9. A method of polishing a concrete surface as defined in claim 1 further comprising the steps of:

said organic curable liquid coating being one of an organic epoxy, acrylic, alkyd, oil or urethane base systems.

* * * * *